US006352446B2

(12) United States Patent
Ezawa et al.

(10) Patent No.: US 6,352,446 B2
(45) Date of Patent: Mar. 5, 2002

(54) MODULAR JACK ASSEMBLY HAVING LIGHT TRANSMISSION MEANS WITH A LIGHT INDICATOR

(75) Inventors: Katsuya Ezawa; Tatsuya Arai; Shigeru Kikuta; Hideo Miwa, all of Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/725,483

(22) Filed: Nov. 30, 2000

Related U.S. Application Data

(63) Continuation-in-part of application No. 09/274,208, filed on Mar. 23, 1999, now abandoned.

(30) Foreign Application Priority Data

Mar. 25, 1998 (JP) ..... 10-76899

(51) Int. Cl.[7] ..... H01R 3/00
(52) U.S. Cl. ..... 439/490
(58) Field of Search ..... 439/490, 489, 439/488, 344, 676, 619, 717

(56) References Cited

U.S. PATENT DOCUMENTS 5,345,520 A * 9/1994 Grille ..... 385/15
5,741,152 A * 4/1998 Boutros ..... 439/490
5,876,239 A * 3/1999 Morin et al. ..... 439/488
6,095,851 A * 8/2000 Laity et al. ..... 439/490
6,113,422 A * 9/2000 Somerville et al. ..... 439/490

* cited by examiner

*Primary Examiner*—Brian Sircus
*Assistant Examiner*—Chandrika Prasad
(74) *Attorney, Agent, or Firm*—Kanesaka & Takeuchi

(57) ABSTRACT

A modular jack assembly with an indicator comprises a housing (19) made of an insulative material and consisting of two tiers, each tier having at least one through-hole (15) and at least one opening (18*a* or 18*b*) for receiving a mating connector. The modular assembly further comprises at least one light transmission means (11D) for transmitting light, which is provided in the through-hole and has a light receiving member (13) at one end for receiving light from a corresponding light source (6*a* OR 6*b*) mounted on a board outside of the modular jack assembly and disposed in a line along a rear wall of the housing and an indicator member at the other end for displaying the light to the outside of the modular jack assembly. The transmission means provided in the through-hole of an upper tier extends upwardly from the light receiving member along the rear wall, bent at right angles into an upper wall of the upper tier and then bent diagonally along the upper wall of the upper tier. The light transmission means provided in the through-hole of a lower tier extends upwardly from the light receiving member along the rear wall and bent at right angles into and through an upper wall of the lower tier.

4 Claims, 23 Drawing Sheets

MODULAR JACK ASSEMBLY HAVING LIGHT TRANSMISSION MEANS WITH A LIGHT INDICATOR

This application is continuation-in-part of U.S. application Ser. No. 09/274,208, filed on Mar. 23, 1999, and now abandoned, which claims the benefit of Japanese Application No. 10-76899, filed on Mar. 25,1998.

BACKGROUND OF THE INVENTION

1. Field of the Invention

The present invention relates to connectors with an indicator and, particularly, to a connector with an indicator whose light source is located outside.

2. Description of the Related Art

European patent No. 0740370 A1 and Japanese patent application Kokai No. 8-148230 disclose connectors with an indicator wherein a display of light from an LED is used to indicate plugging between a modular jack assembly and a modular plug or reception of a signal by a modular jack assembly from a modular plug. In the above European patent, an LED is incorporated in the rear portion of a connector, and light of the LED is guided to the outside by an optical pipe, which is inserted from the front side to the back side of the connector. In the above Japanese patent, an LED is provided in the front face of the connector such that part of the LED is exposed so that light of the LED is displayed directly, with the result that no optical pipe is required. This LED is also inserted into the connector from the front face to the rear face.

To incorporate the LED, it is necessary to provide a space for the incorporation, resulting in the bulky connector. The location of LED incorporation limits the display position of light, and its change is also not easy. In addition, the size and shape of an LED incorporated are limited, providing a narrow range of usable LED. Once incorporated, the LED is impossible or very difficult to replace it. In the above European patent, it is very difficult to change the shape of an optical pipe to change the location of light display. In the multiple linked connector, it is very complicated to assemble the LED's and optical pipes.

SUMMARY OF THE INVENTION

Accordingly, it is an object of the invention to provide a compact connector having a wide range of LED selection and easy to change the display location by changing the shape of an optical pipe.

It is another object of the invention to provide a connector wherein it is easy to replace the LED.

It is still another object of the invention to provide a linked type connector which is easy to assemble.

According to one aspect of the invention there is provided a modular jack assembly with an indicator, comprising a housing; and a light transmission unit for transmitting light and having a light receiving member at one end for receiving light from outside of the modular jack assembly and an indicator member at the other end for displaying the light at the outside of the modular jack assembly.

According to one embodiment of the invention, the light transmission unit is an optical pipe.

According to another aspect of the invention, the light transmission unit is an optical fiber.

According to still another embodiment of the invention, the light receiving member and the indicator member are transparent and part of the light transmission unit between the light receiving member and the indicator member is empty.

According to yet another embodiment of the invention, the light transmission unit a prefabricated light transmission member incorporated in the housing.

According to another embodiment of the invention, the housing is provided a plurality of openings in which a plurality of the light transmission unit are incorporated at once.

According to still another embodiment of the invention, the light transmission unit is a transparent resin put into the colored housing.

According to yet another embodiment of the invention, the light transmission unit is a transparent member integrally molded with the housing.

According to another embodiment of the invention, part of the light transmission unit is located within the housing.

According to still another embodiment of the invention, substantially all of the light transmission unit is located within the modular jack assembly.

According to yet another embodiment of the invention, the light receiving member is convex.

According to another embodiment of the invention, the light transmission unit extends straight between the light receiving member and the indicator member.

According to still another embodiment of the invention, the light transmission unit has an L-shaped form.

BRIEF DESCRIPTION OF THE DRAWINGS

FIG. 5(*c*) is a perspective view of a modified device of the first embodiment;

FIG. 11(*B*) is a perspective view of another modified second embodiment of the invention;

DESCRIPTION OF THE PREFERRED EMBODIMENTS

Figure 1:
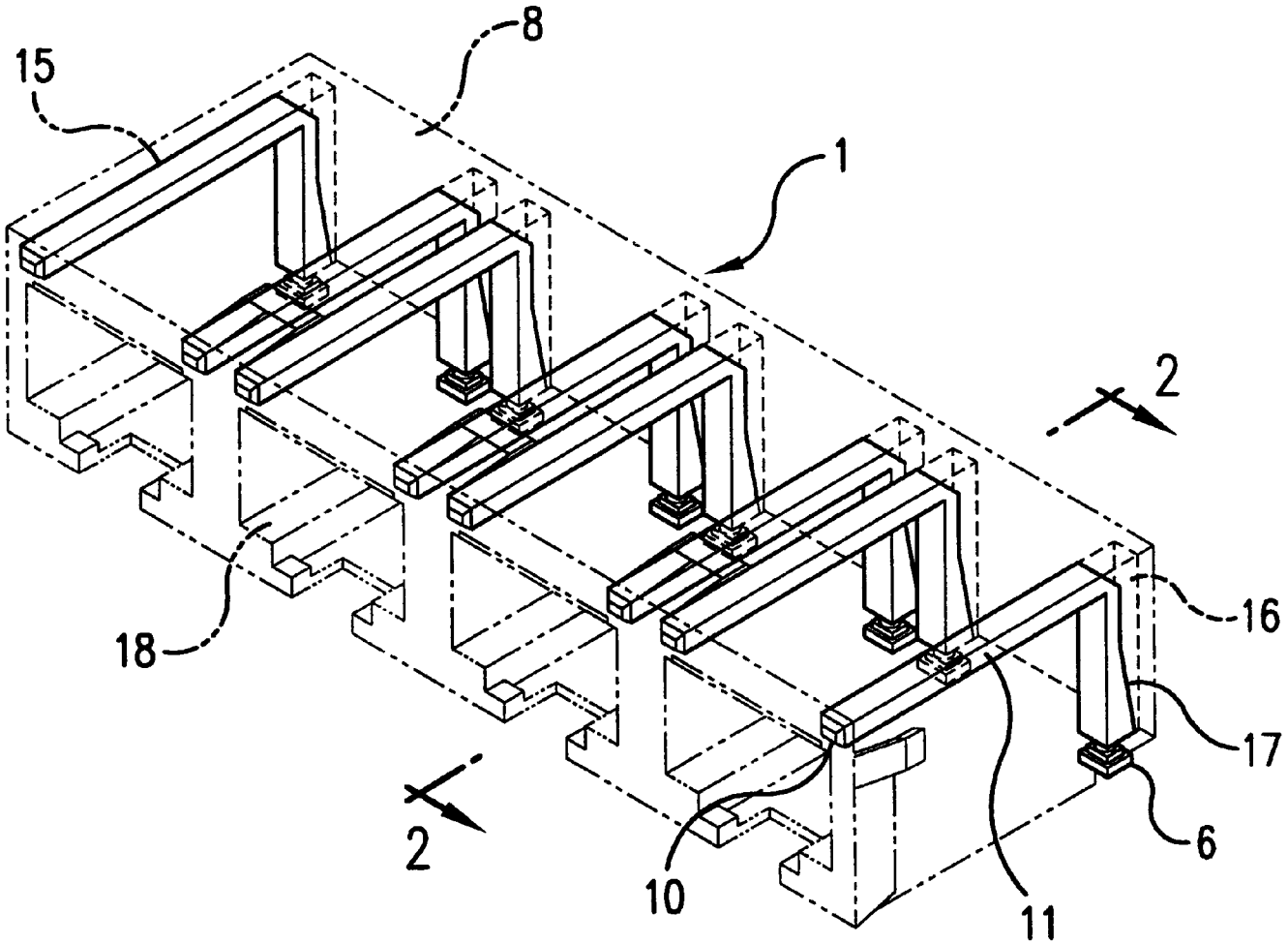
FIG. 1 is a perspective view of a modular jack assembly of the upper indicator, right-angle optical pipe system according to the first embodiment of the invention.
Figure 2:
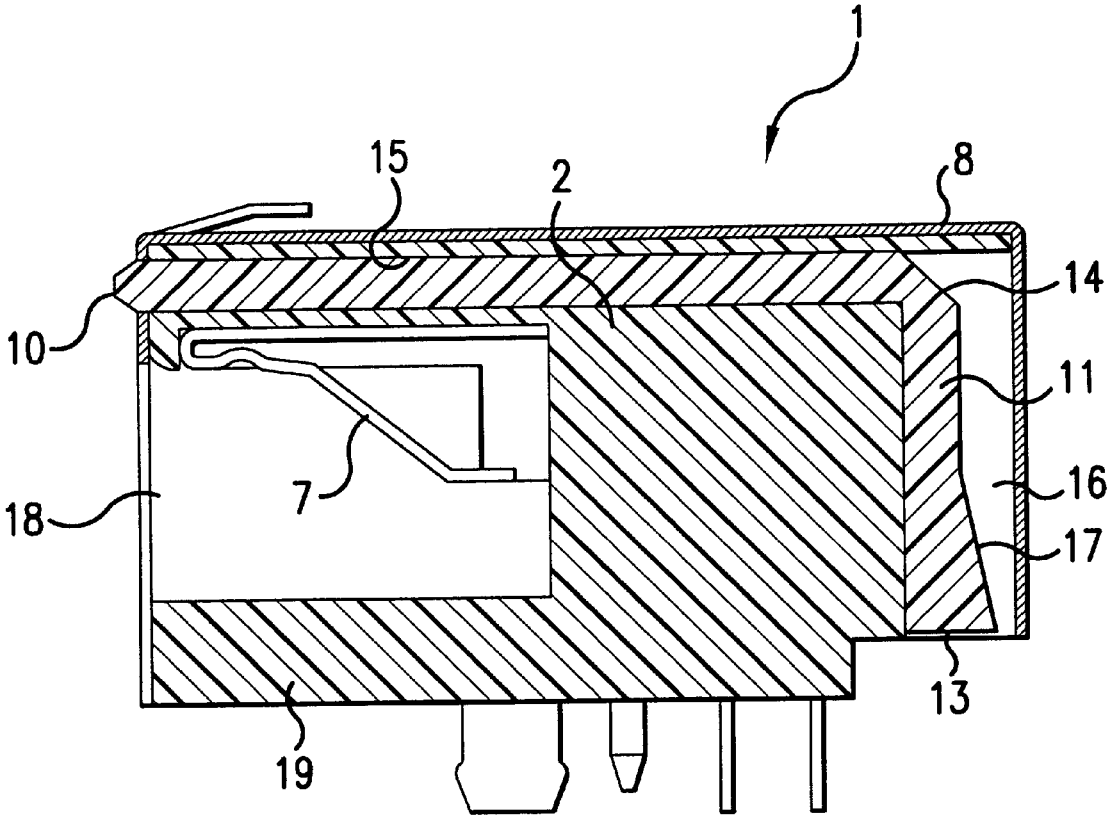
FIG. 2 is a sectional view taken along line 2—2 of FIG. 1.

FIGS. 1 and 2 show the first embodiment of the invention or a multiple-type modular jack assembly wherein four modular jacks of the same configuration are arranged side by side. This multiple-type modular jack assembly is of the upper indicator right angle optical pipe system. As the name indicates, eight indicator members 10 are provided on the upper side of the modular jack assembly 1. Eight optical pipes 11 are bent at right angles. Eight LED's 6 are provided at the ends of the vertical sections of the optical pipes 11. FIG. 2 is a sectional view taken along line 2—2 of FIG. 1.

The LED's 6 are placed at the back of the modular jack assembly and exposed to the outside. They are mounted on a board, and each LED gives off light in a direction perpendicular to the board. Since the LED's are placed outside the modular jack assembly, it is possible to use a variety of LED's. In addition, no space is necessary within the modular jack assembly. Moreover, it is easy to replace LED's. When a modular plug is plugged in the modular jack assembly and the contact element 7 (FIG. 2) of the modular jack assembly 1 receives a signal from the corresponding contact element of a modular plug, the LED 6 emits light.

The light from each LED 6 is transmitted to the outside of the modular jack assembly 1 by the optical pipe 11. The rear end 13 of the optical pipe 11 is opposed to the LED 6. This rear end 13 is made flat. The front end of the optical pipe 11 slightly projects from the front end of the modular jack assembly 1, forming the indicator member 10. A reflector 14 is provided between the horizontal and vertical sections of the optical pipe 11 such that the light of the LED 6 is reflected to the front end of the optical pipe 11.

The optical pipe 11 is made of a transparent resin. As far as it is transparent, it does not matter to have a color or not. It is made by either pouring a transparent resin into a predetermined place of a housing 19 of the modular jack assembly 1 to form a particular shape or forming an optical pipe 11 of a predetermined shape and then incorporating it into the housing 19 at a predetermined place. Unlike optical fibers, the optical pipe 11 is not flexible. If the former forming method is used, it is preferred that the housing 19 is made opaque to facilitate distinction between the housing 19 and the optical pipe 11.

Corresponding to the shape of the optical pipe 11, the housing 19 has a through-hole 15 extending horizontally from the rear to the front face of the housing and a guiding groove 16 extending vertically in the rear face. When the optical pipe 11 is placed in the housing 19 at a predetermined position, the horizontal and vertical sections of the optical pipe 11 are fixed in the through-hole 15 and the guiding groove 16, respectively, of the housing 19. Like the through-hole 15, the guiding groove 16 works as a locator for guiding the vertical section of the optical pipe 11 toward the housing. When the optical pipe 11 is placed at the predetermined position, the vertical section of the optical pipe 11 is surrounded by the guiding groove 16 except for the back side 17 and the end face which are exposed to the outside. In the method by which the optical pipe is incorporated at a predetermined position, the optical pipe 11 is incorporated in the housing 19 from the rear to the front side.

After the optical pipe 11 is placed in the housing 19 at the predetermined position, the entire surfaces of the housing 19 except the bottom surface and an opening 18 for receiving a modular plug is covered by a shield case 8. Consequently, the optical pipe 11 is completely covered except for the end face, thereby providing the modular jack assembly 1 with a high shield effect.

Figure 3:
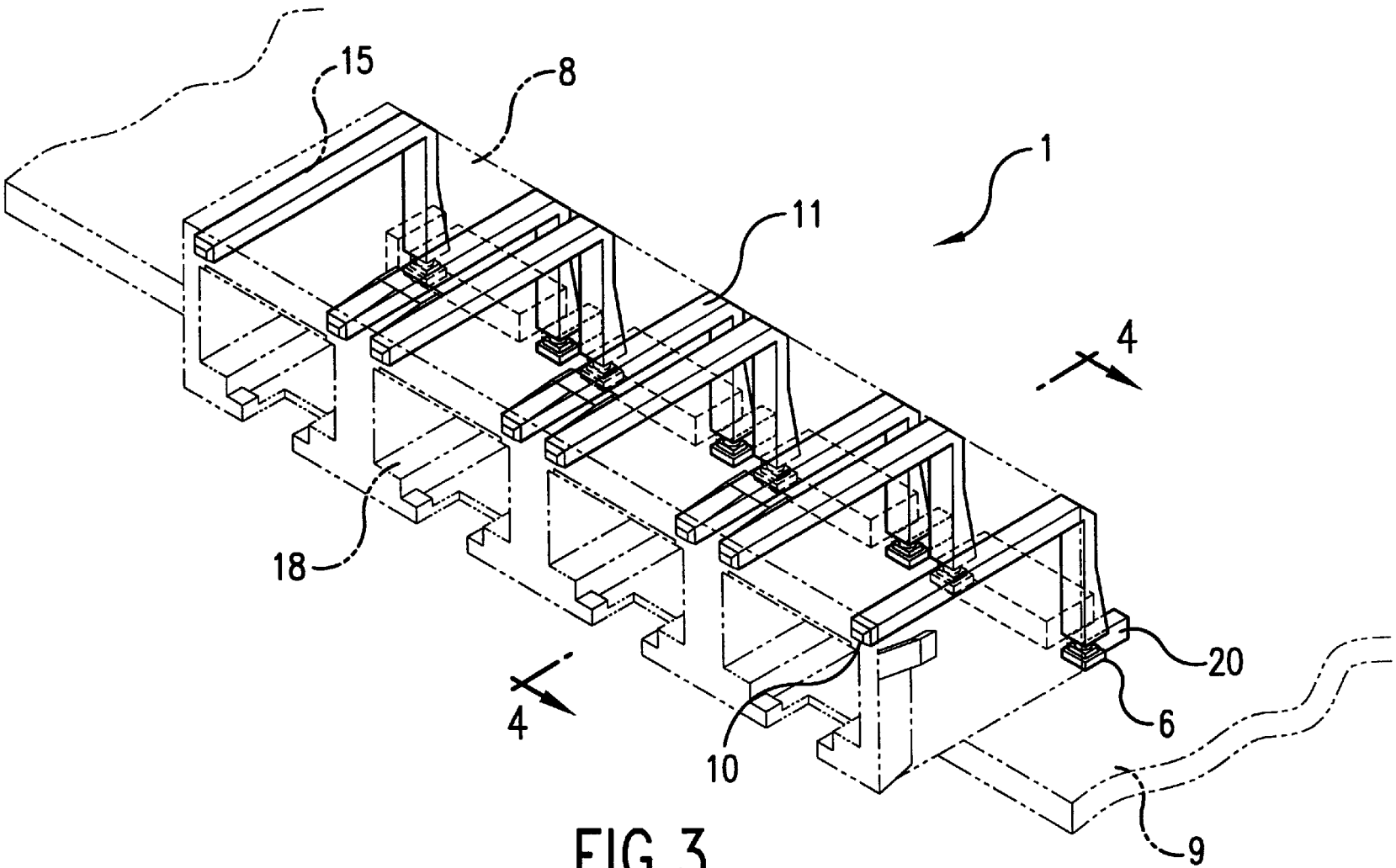
FIG. 3 is a perspective view of a modified device of the first embodiment wherein part of the optical pipes are exposed.
Figure 4:
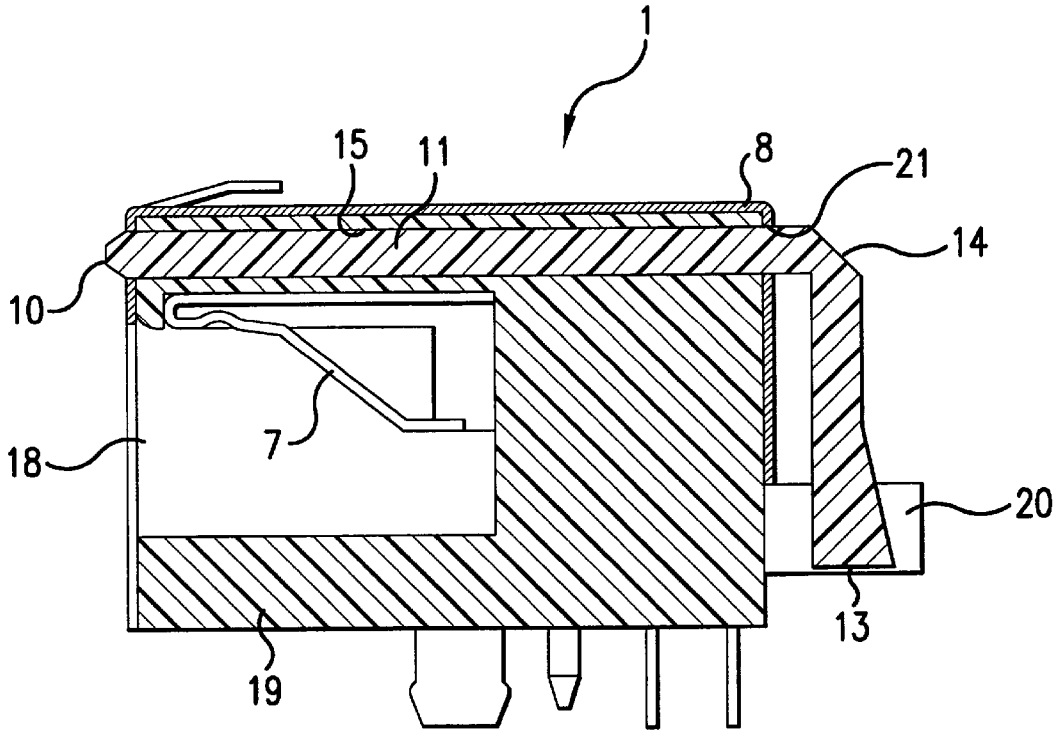
FIG. 4 is a sectional view taken along line 4—4 of FIG. 3.

FIGS. 3 and 4 show a modification to the first embodiment of the invention. In this modification, the horizontal sections of optical pipes 11 are fixed to the housing 19 but the vertical sections are spaced from the rear face of the housing 19. Corresponding to such optical pipes 11, only through-holes 15 are provided in the housing 19 and no guiding grooves are provided. However, a pair of positioning plates 20 are provided so as to extend rearwardly from the rear face of the housing 19. The vertical section of the optical pipe 11 is flanked and guided by these positioning plates 20 to a predetermined position. The optical pipe is separately formed and then incorporated into the housing 19. The shield case 8 is attached to the housing 19 prior to the incorporation of the optical pipes 11 in the housing 19. Holes 21 are provided in the shield case 8 at predetermined positions to incorporate the optical pipes 11. This modified device is less effective in the shield effect than the first embodiment but easier to assemble than the first embodiment.

Figure 5A:
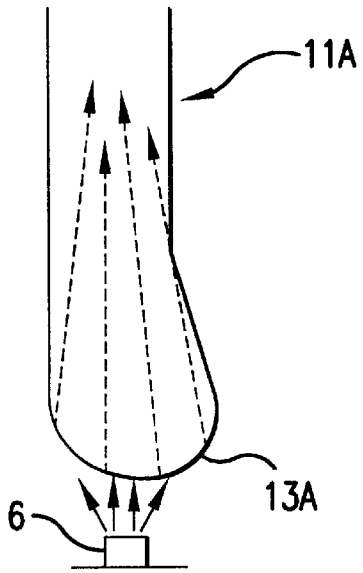
FIGS. 5(*a*) and (*b*) are side views of ends of optical pipes near LED's.
Figure 5B:
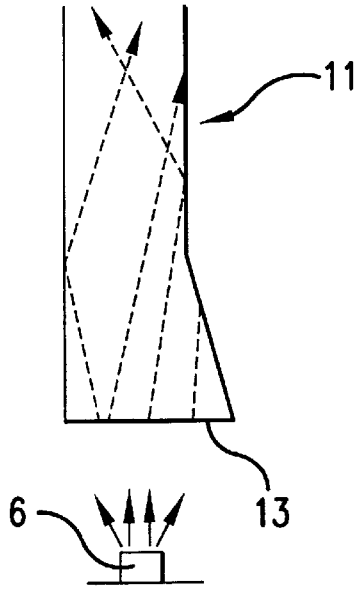
Figure 5C:
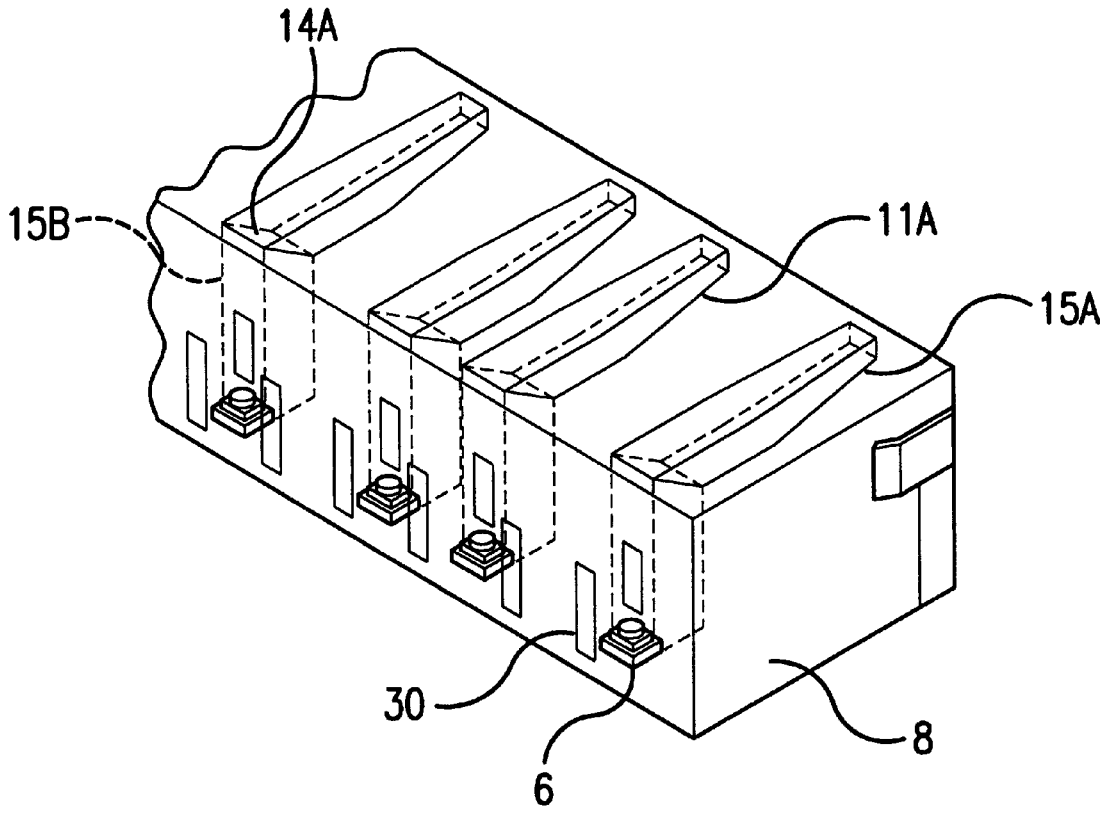

FIG. 5(*a*) shows a second modification to the above embodiments of the invention, wherein the end face 13A of an optical pipe 11A is opposed to an LED 6. FIG. 5(*b*) shows the flat end face 13 of the optical pipe 11 in the above embodiment so that rays of light from the LED 6 do not run straight within the optical pipe 11 and there is some leak of light. By contrast, the end face 13A of the optical pipe 11A is provided with convex light collecting face so that rays of light run straight within the optical pipe 11A and there is little leak of light, thus providing efficient guiding of light.

FIG. 5(*c*) shows the third modification to the first embodiment of the invention. The housing 19 is provided with a plurality of horizontal and vertical through-holes 15A and 15B. A plurality of optical pipes 11A are fixed in the horizontal through-holes 15A, but the vertical through-holes 15B are empty. A reflecting face 14A is provided on an end of each optical pipe 11A between the horizontal and vertical through-holes to reflect light of an LED 6 to the other end of the optical pipe 6 on the side where a modular plug is plugged. Since only the horizontal optical pipes are used, this modified device is better in assembling efficiency than the embodiment of FIGS. 1 and 2 where the optical pipes are bent at right angles. A plurality of openings 30 are provided in the shield case 8 around the LED's to vent the heat emitted from the LED's.

Figure 6:
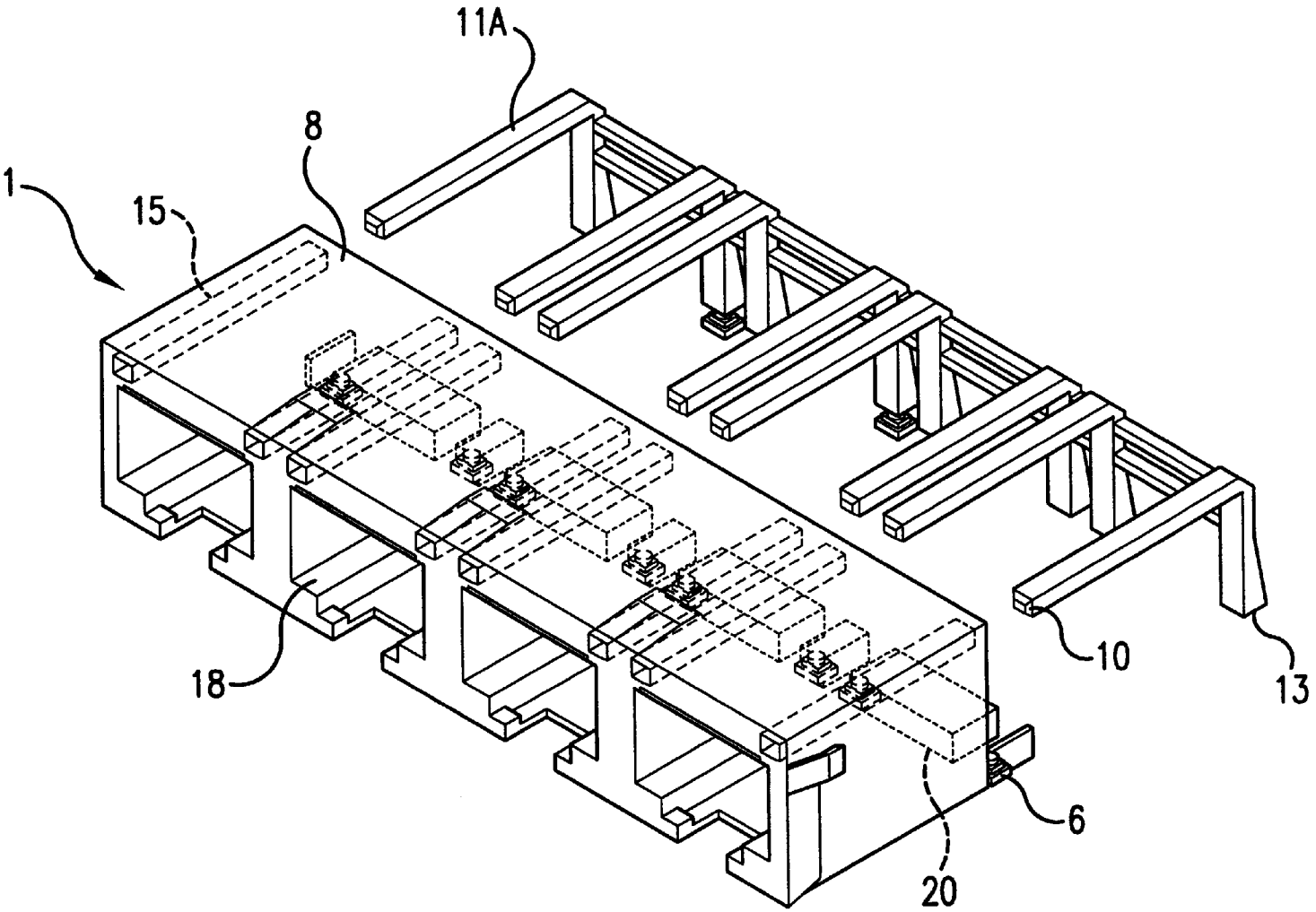
FIG. 6 is a perspective view showing an optical arm simultaneous incorporation system.

FIG. 6 shows the fourth modification to the first embodiment of the invention. In this modification, a multiple type optical pipes 11A has eight optical pipes linked by linking arms. In the incorporation method, it is possible to incorporate eight optical pipes in the housing 19 at once, thus maximizing the assembling efficiency. Light does not leak to another optical pipe so that the multiple type optical pipe 11A has no adverse influence on the performance of the modular jack assembly 1. The number of optical pipes linked may be different.

Figure 7:
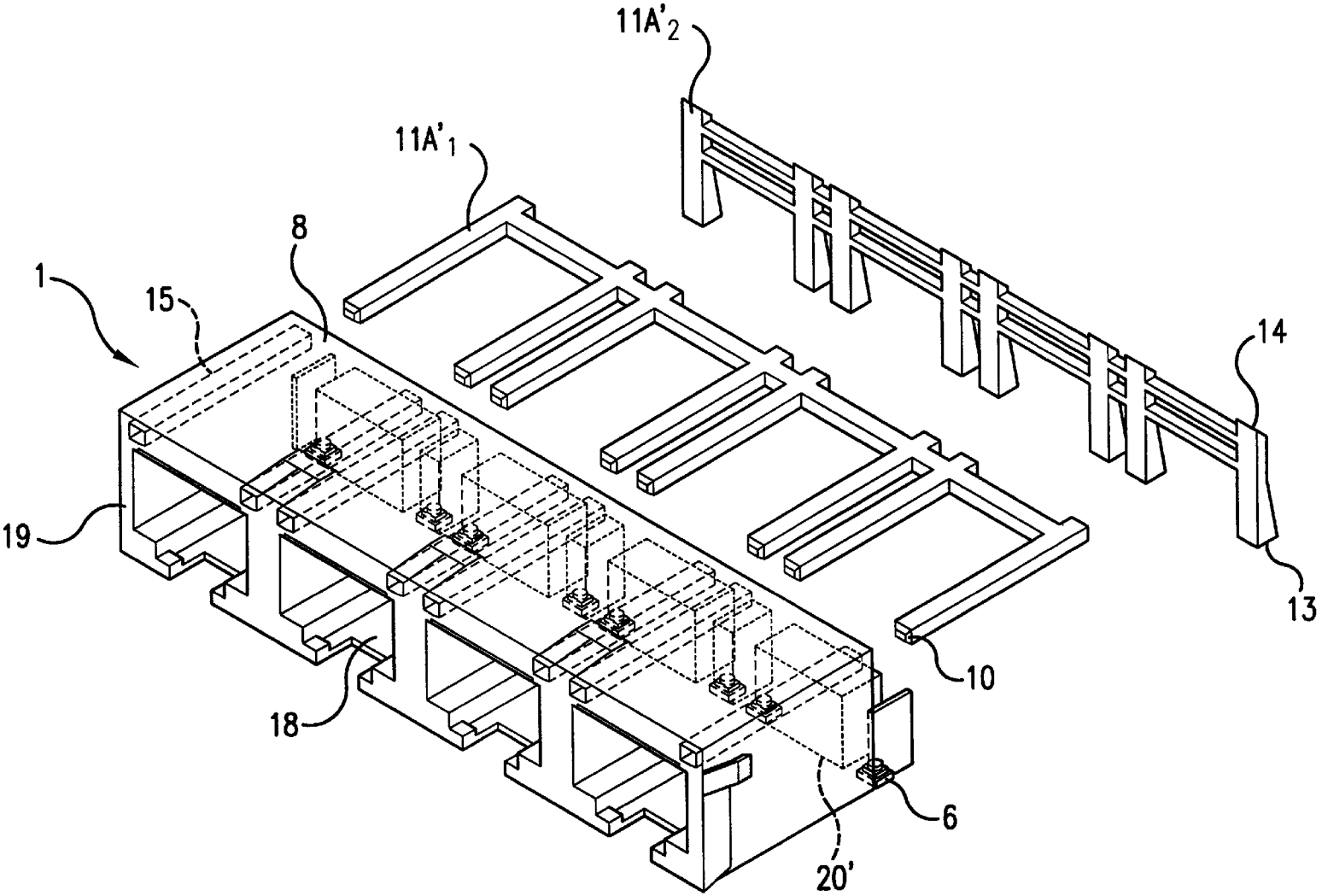
FIG. 7 is a perspective view showing a two-component optical arm simultaneous incorporation system.

FIG. 7 shows an application of the fourth modification. Optical pipes 11A' divided into tow straight components; that is, horizontal sections 11A'1 and vertical sections 11A'2. The strength of the optical pipes consisting of the two components is higher than that of the optical pipes made up of one component as shown in FIG. 6. Since the respective sections are straight, it is easier to store than the right-angle type as shown in FIG. 6. To install the optical pipe 11A' to the housing 19, the horizontal sections 11A'1 are inserted into through-holes 15 of the housing 19, and the vertical sections 11A'2 are positioned by a plurality of positioning locators 20'. Since the respective sections 11A'1 and 11A'2 are straight and strong, the components are not damaged and are easier to assemble than the right-angle type. Since the horizontal and vertical sections are separated, the height of the positioning locators 20' is greater than that of the positioning locator 20 in FIG. 6 to assure positioning of the vertical sections.

Figure 8:
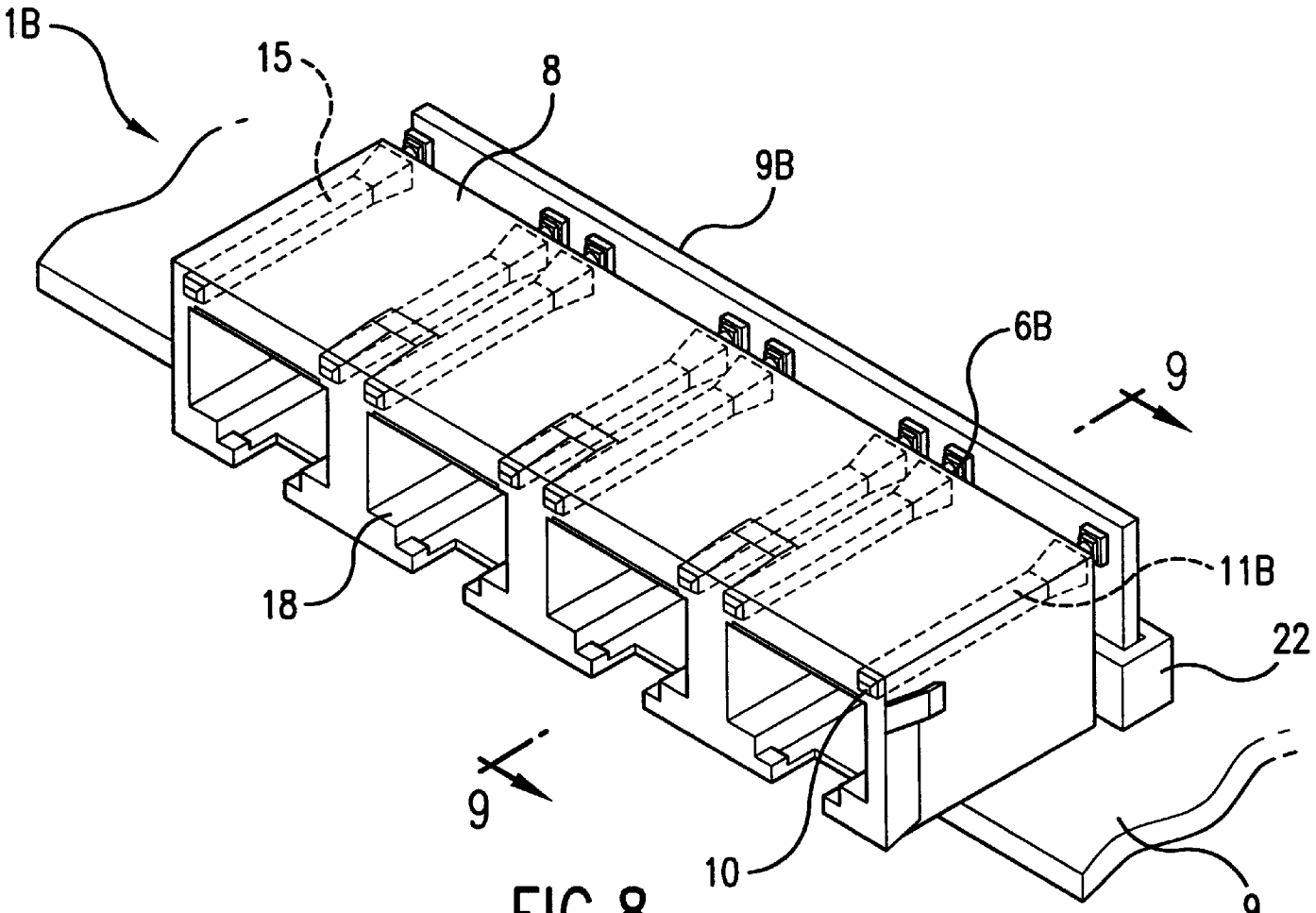
FIG. 8 is a perspective view of an upper indicator, straight optical pipe system modular jack assembly according to the second embodiment of the invention.
Figure 9:
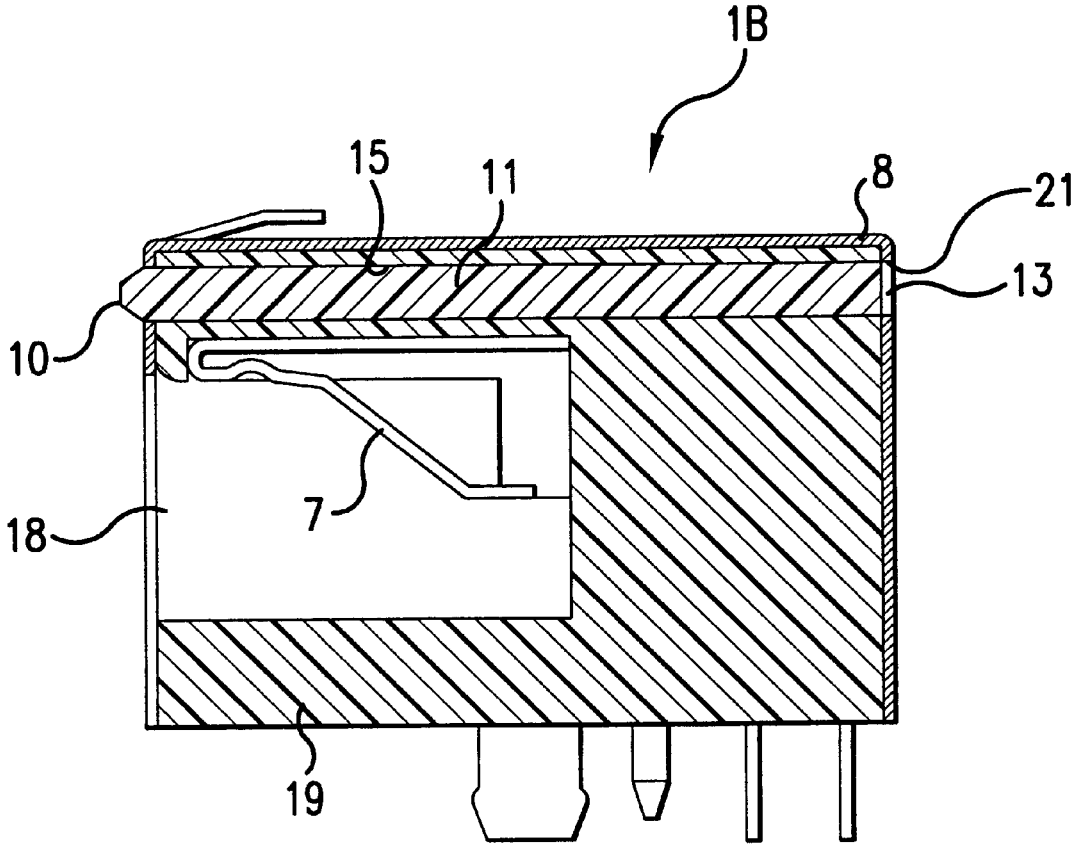
FIG. 9 is a sectional view taken along line 9—9 of FIG. 8.

FIGS. 8 and 9 show the second embodiment of the invention. This embodiment is of the upper indicator straight type optical pipe system. This system comprises indicator members 10 on the upper side of a modular jack assembly and straight optical pipes 11B.

In FIG. 8, LED's 6B are spaced from the back of a modular jack assembly 1B. The LED's 6B are mounted on a vertical board 9B to emit light in the horizontal direction. The vertical board 9B attached to a PCB connector 22 is removable so that it is easy to replace LED'S.

The light of each LED 6B is directed to the outside by the optical pipe 11B incorporated in the modular jack assembly 1B. One end face 13 of each optical pipe 11B is opposed to the LED 6B. The end face 13 is made flat. The other end face slightly projects from the front end of the modular jack assembly and has an indicator member 10. Since the optical pipe 11B is made straight, light is guided from the LED-side end face 13 to the other end face without reflection.

The optical pipe 11B is made from a colored or colorless transparent resin. The methods of making such an optical pipe 11B include 1) pouring a transparent resin into a predetermined position in the housing 19 to form a specific shape and 2) forming an optical pipe 11B of a specified shape and incorporating it in the housing 19 at a predetermined position. Unlike optical fibers, the optical pipe 11B is not flexible. The housing 19 is either transparent or opaque but when the first method 1) is used, it is preferred to use an opaque housing for easy distinction between the housing 19 and the optical pipe 11B.

Corresponding to the shape of the optical pipes 11B, the housing 19 is provided with through-holes 15. When the optical pipe 11B is placed at a predetermined position in the housing 19, it is surrounded by the walls of a through-hole except for the end faces. In the second method 2), the optical pipe 11B is incorporated into the housing 19 either the rear-to-front or front-to-rear direction.

The entire surface of the housing 19 except for the bottom surface, openings 18 for plugging modular plugs, and holes 21 for incorporating the optical pipes 11B is covered by a shield case 8, thus providing excellent shield effects. Since the optical pipes 11B are straight, the shield case 8 can be attached either before or after the optical pipes 11B are incorporated.

Figure 10:
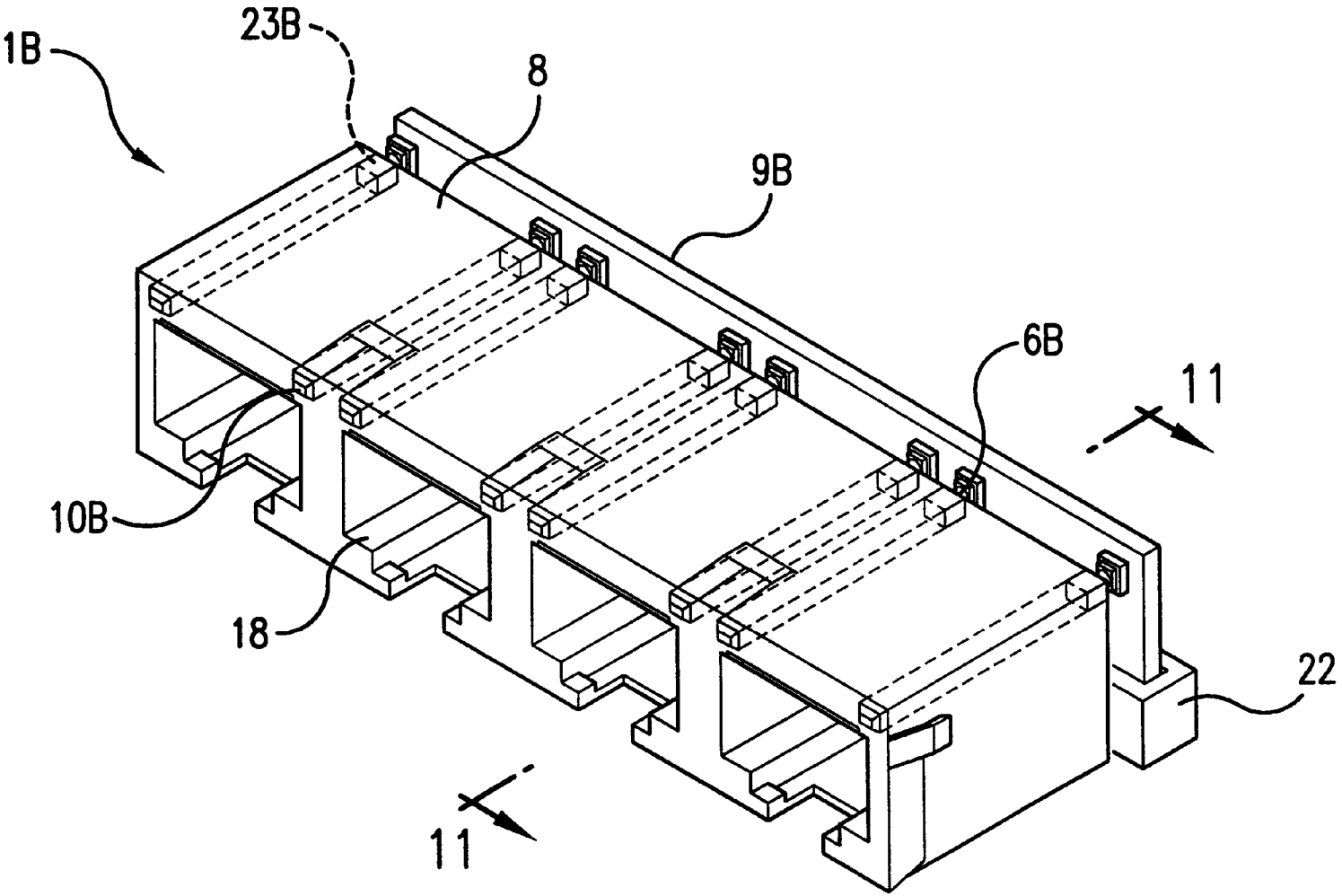
FIG. 10 is a perspective view of a modified second embodiment of the invention, wherein no optical pipe is used.
Figure 11:
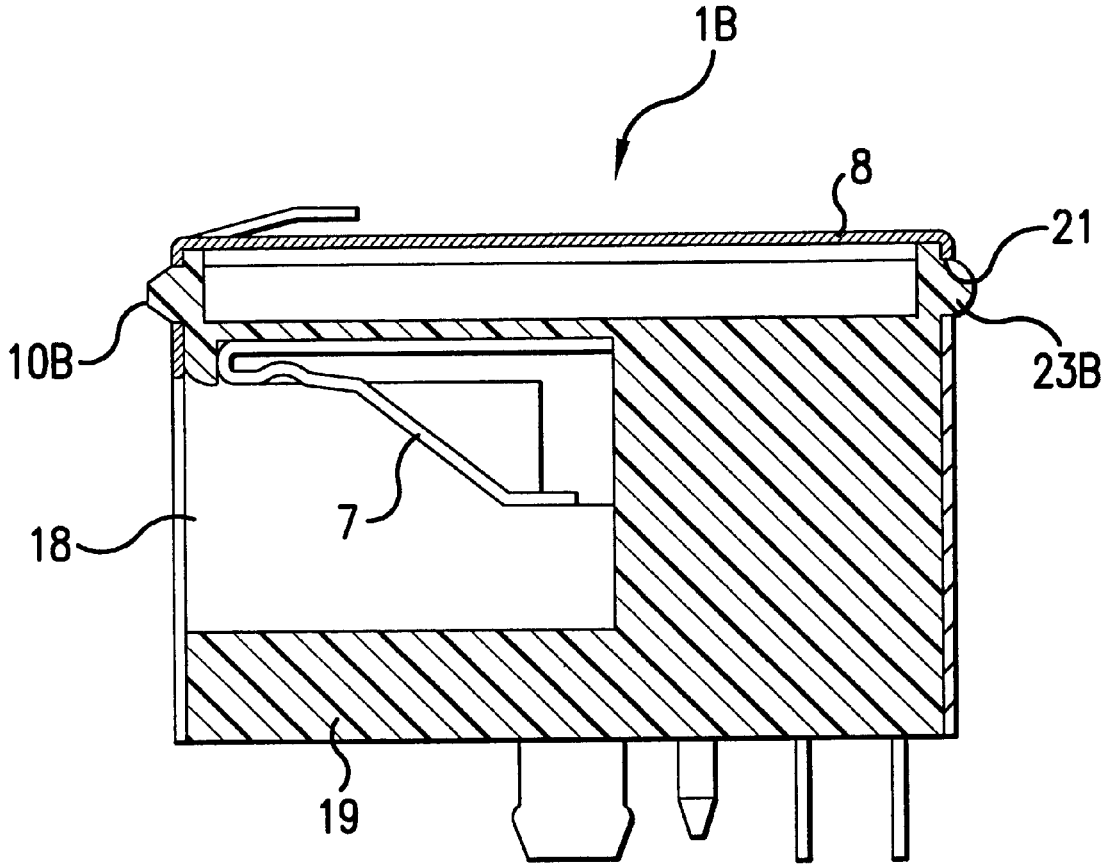
FIG. 11 is a sectional view taken along line 11—11 of FIG. 10.

FIGS. 10 and 11 show the first modification to the second embodiment. In this modification, the optical pipes 11B are replaced by light receiving members 23B opposed to LED's and indicator members 10B provided on the front face of a modular jack assembly. The light receiving members 23B have a hemispheric convex surface on the LED side and a flat surface on the opposite side. The indicator members 10B have a flat surface on the side of light collecting members 23B. Rays of light from the LED 6B are made parallel by the convex lens of the light receiving member 23B. The parallel rays of light are then received by the indicator member 10B for display. Thus, the amount of light leak is reduced, and the efficiency of guiding light is increased. The light receiving members 23B and the indicator members 10B are formed as a part of the housing 19. Since the theses components must be transparent, and the housing 19 is molded from a transparent resin as a unit. Consequently, it is very easy to assemble this modified unit. Since the rays of light are made parallel by the convex lens of the light receiving members, very few rays leak into members other than the indicator members 10B.

Figure 11A:
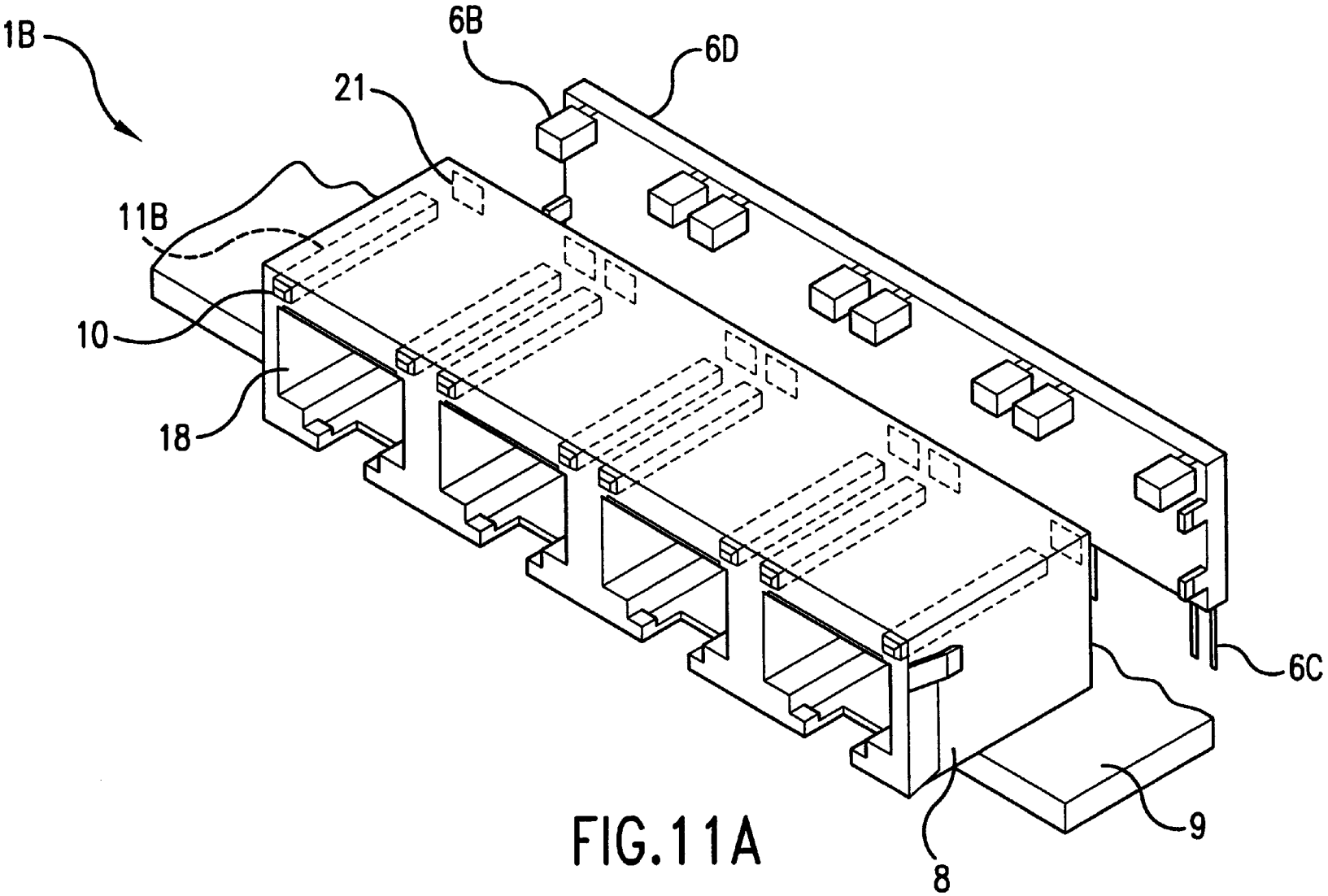
FIG. 11A shows a modification of the second embodiment.

FIG. 11(A) shows the second modification to the second embodiment. A plurality of leads 6C of LED's 6B extend toward the horizontal board 9. The LED's and their leads are held by an LED holder 6D so that it is not necessary to mount LED's on a vertical board, thereby cutting the manufacturing costs. Since it is possible to mount simultaneously both the LED's and the modular jack assembly 1B on a horizontal board 9, it is very easy to assemble.

Figure 11B:
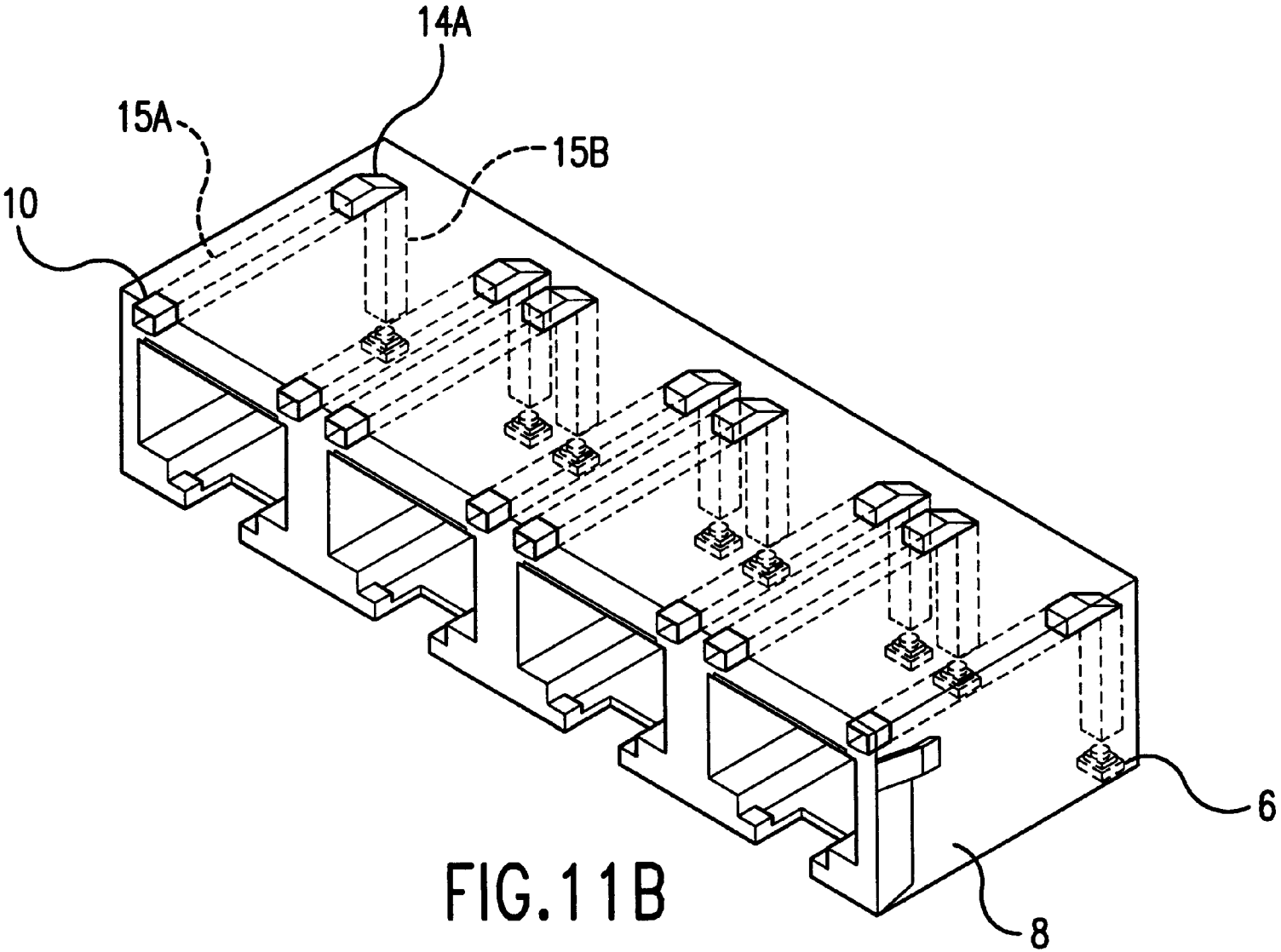

FIG. 11(B) shows the third modification to the second embodiment. A housing 19 is provided with a plurality of horizontal through-holes 15A and a plurality of vertical through-holes 15B. Both the through-holes 15A and 15B are empty. A plurality of reflection members 14A are provided at positions between the horizontal and vertical through-holes to reflect the light of LED's to the other end of optical pipes. This modified device is less expensive and more efficient to assemble than the embodiment of FIGS. 1 and 2 because only the reflection members are required.

Figure 12:
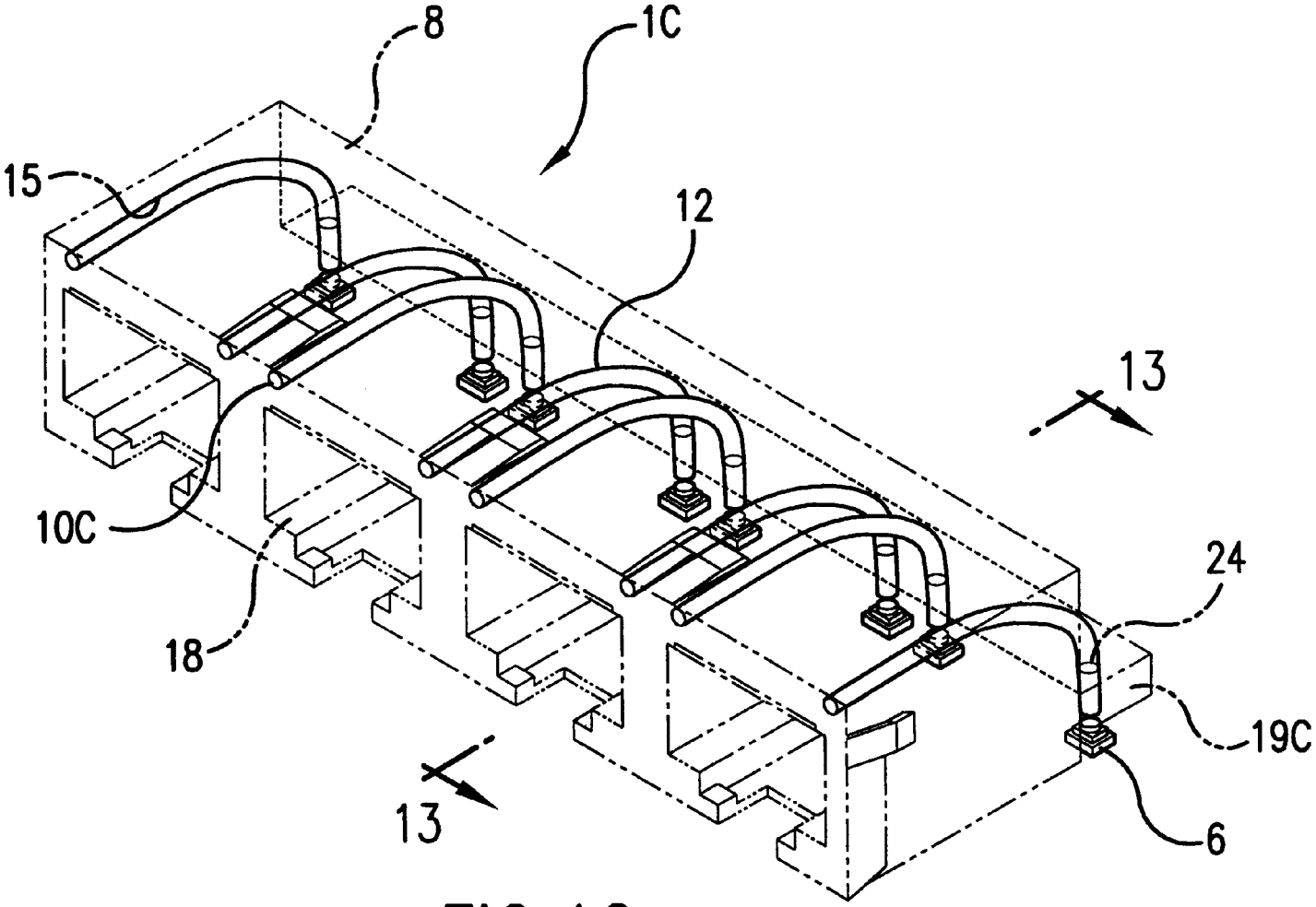
FIG. 12 is a perspective view of an upper indicator, optical fiber system modular jack assembly according to the third embodiment of the invention.
Figure 13:
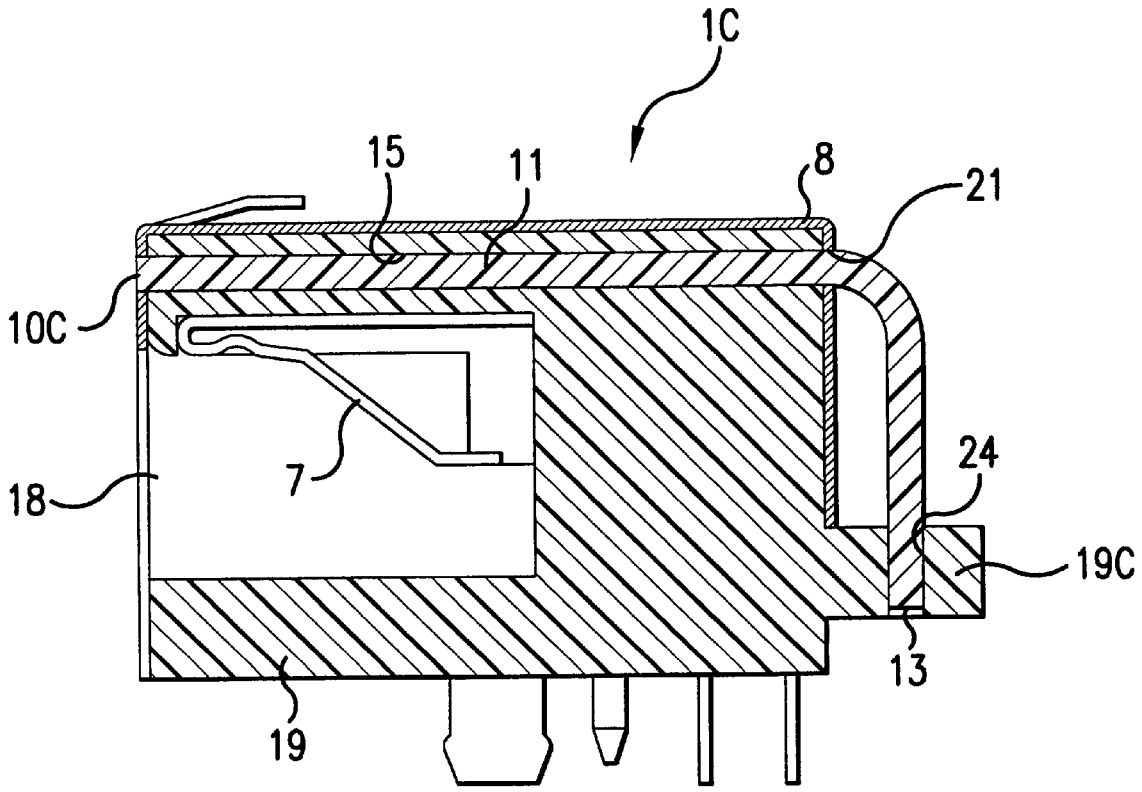
FIG. 13 is a sectional view taken along line 13—13 of FIG. 12.

FIGS. 12 and 13 show the third embodiment of the invention. This embodiment is of the upper indicator, optical fiber type. In this type, the optical pipes are replaced by optical fibers.

In FIG. 12, LED's 6 are spaced from the back of a modular jack assembly 1C. These LED's 6 are mounted on a horizontal board (not shown) and emit light in the vertical direction.

The light of each LED 6 is guided to the outside by an optical fiber or cable 12 incorporated in the modular jack assembly 1C. The optical fiber 12 extends from a position near the LED 6 to the outside of the modular jack assembly 1C. On end face 13 of the optical fiber 12 is opposed to the LED 6, and the other end face is exposed at the front face of the modular jack assembly 1C and has an indicator member 10C. The end face opposed to the LED 6 has a flat surface.

A horizontal portion of the optical fiber 12 is fixed in the housing 19, and the remaining portion is spaced from the rear face of the housing 19. The optical fibers 12 are incorporated into the housing by inserting them into through-holes 15 of the housing 19. Positioning locators 19C extend rearwardly from the rear face of the housing 19 to position the exposed portions of the optical fibers 12. Through-holes 24 are provided in the positioning locators 19C at predetermined positions corresponding to the respective optical fibers 12. The end faces 13 of the optical fibers 12 are fixed at predetermined positions by inserting them into the through-holes 24.

The entire surface of the housing 19 except for the bottom surface, openings 18 for plugging a modular plug, and the holes 21 for incorporating the optical fibers 12 is covered by a shield case 8 to provide excellent shield effects. Since the optical fibers 12 are flexible, the shield case 8 can be attached either before or after the optical fibers 12 are installed.

Figure 14:
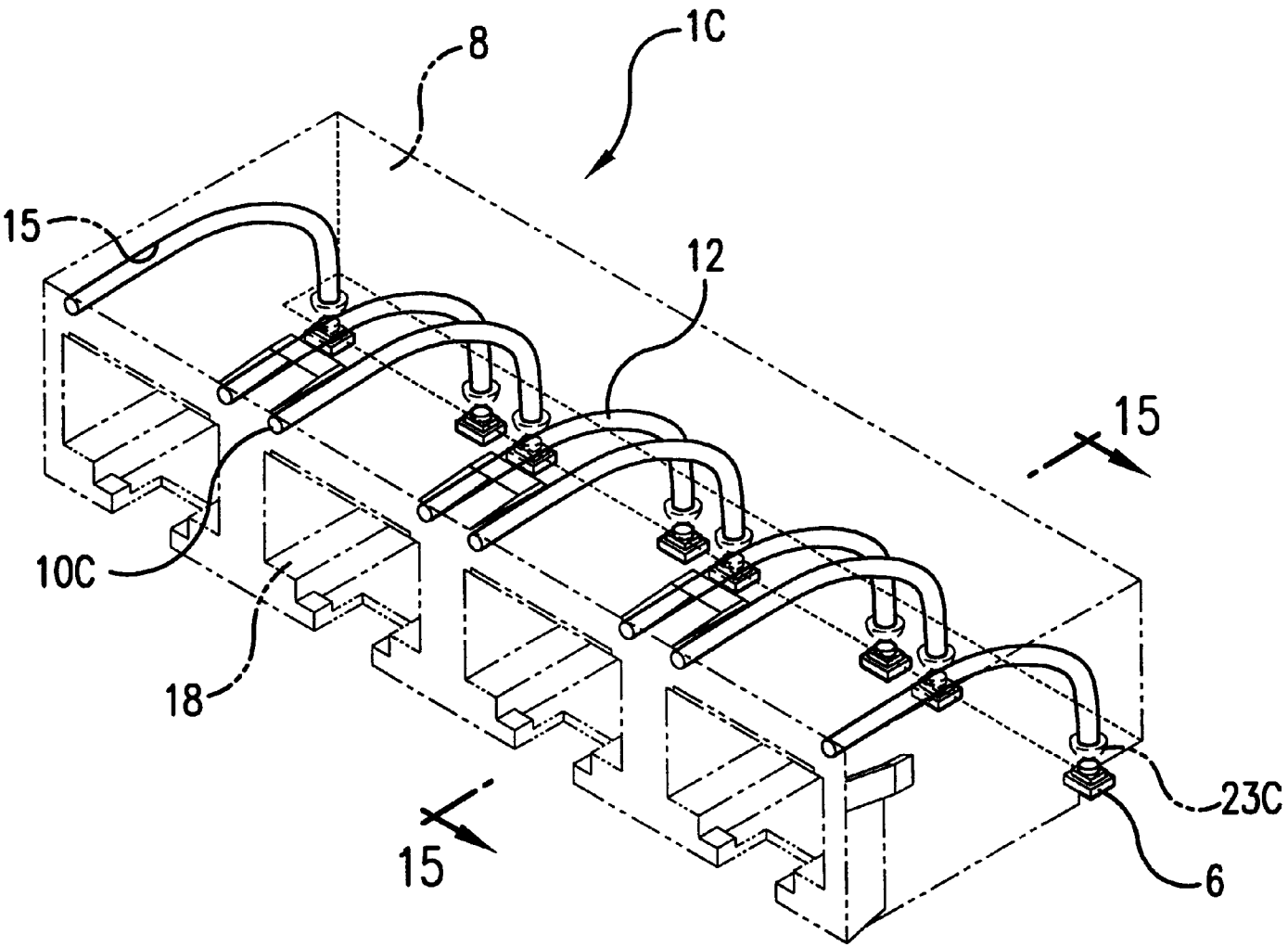
FIG. 14 is a perspective view of a modified third embodiment, wherein light receiving members are provided at the housing.
Figure 15:
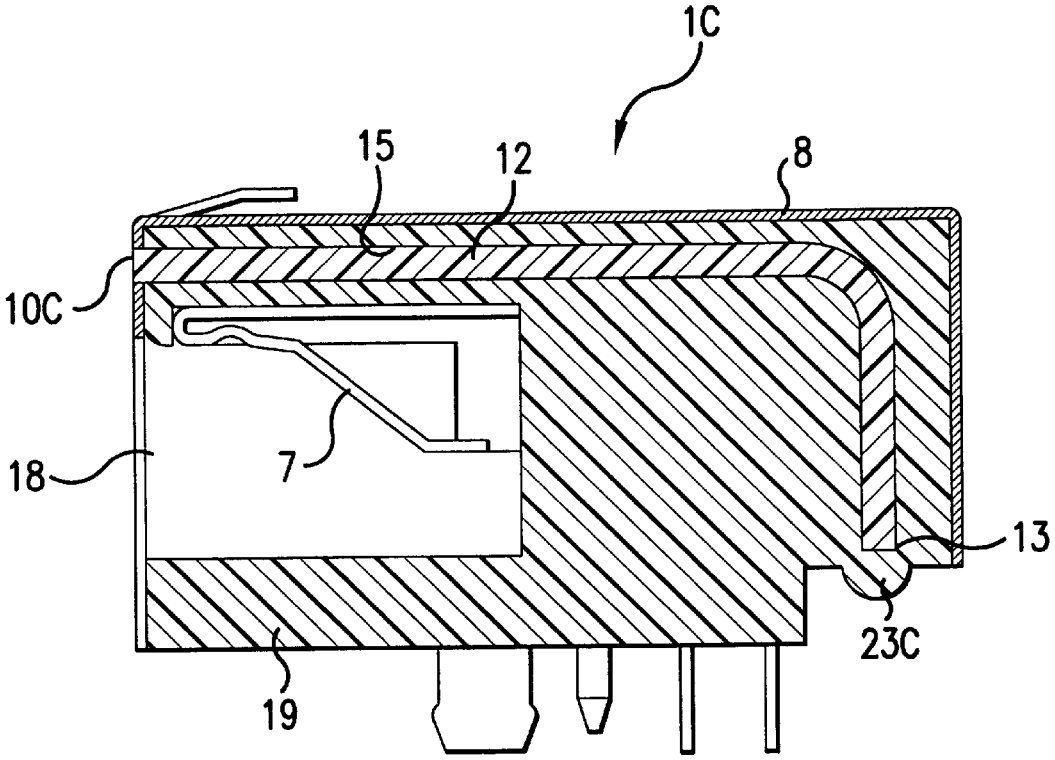
FIG. 15 is a sectional view taken along line 15—15 of FIG. 14.

FIGS. 14 and 15 show a modification to the third embodiment. In this modification, the entire optical fibers 12 are incorporated in the housing 19 to make safer than the embodiment of FIGS. 12 and 13. The housing 19 is provided with light collecting members 23C at positions opposite to LED's 6. The light collecting members 23C have a hemispheric convex shape, to the back of which the end faces 13 of the optical fibers 12 are opposed. The light rays of LED 6 are made parallel by the light receiving member 23C and sent to the optical fiber 12. Thus, there is little light leakage so that the light is guided efficiently. The light receiving members 23 are formed integrally with the housing 19 as a single body and must be transparent so that the housing 19 is molded integrally from a transparent resin. Thus, this modified device is very easy to assemble. The light rays of LED 6 are made parallel by the convex lens of the light receiving member 23 so that there is little light leakage into portions other than the indicator member 10C. The housing 19 is covered by a shield case 8 except for the bottom surface, openings 18 for plugging a modular plug, and holes for incorporating the optical fibers 12.

Figure 16:
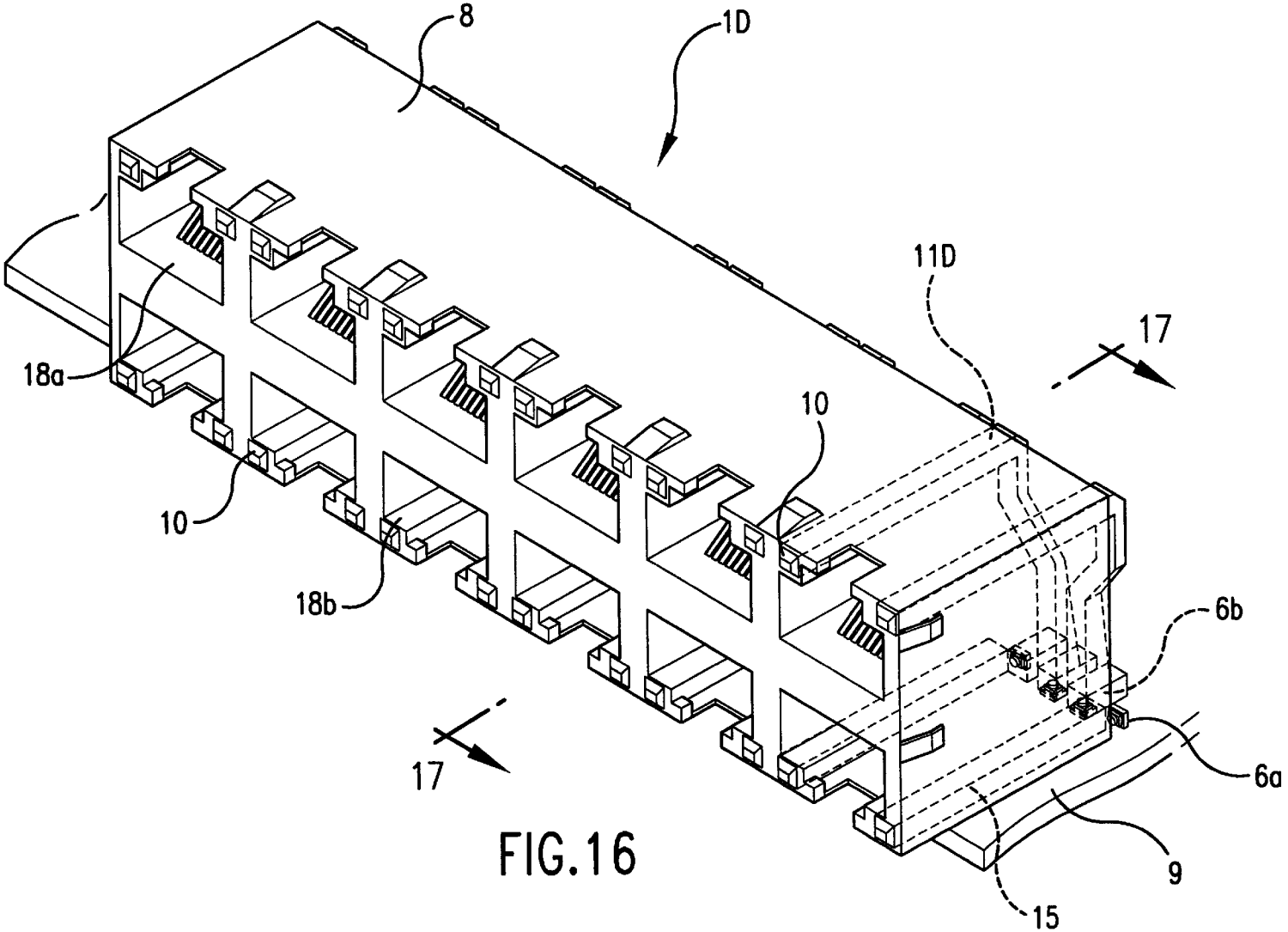
FIG. 16 is a perspective view of an upper and lower indicator right angle optical pipe system modular jack assembly.
Figure 17:
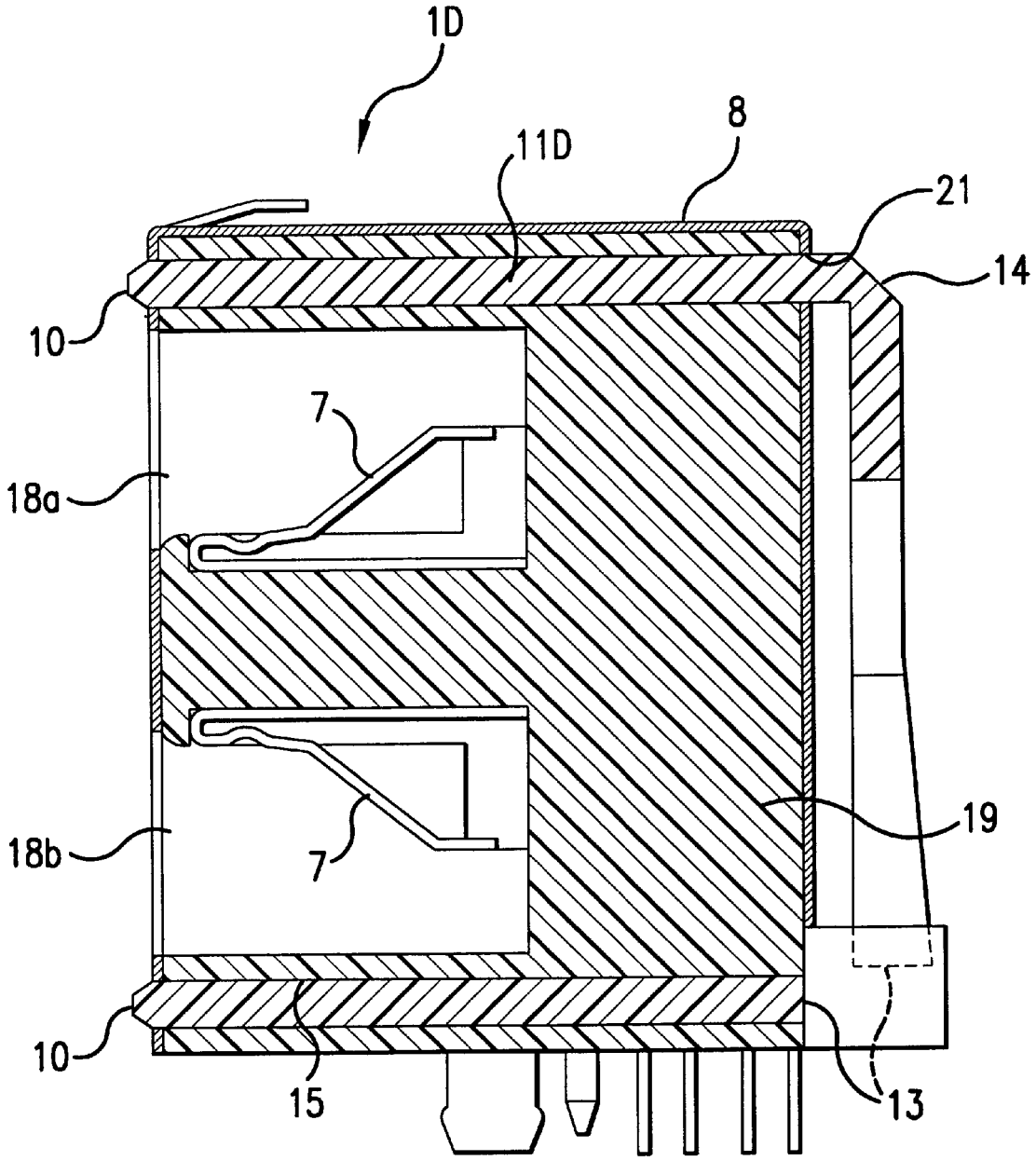
FIG. 17 is a sectional view taken along line 17—17 of FIG. 16.

FIGS. 16 and 17 show the fourth embodiment of the invention. A multiple tier, multiple linked modular jack assembly consisting of 12 modular jack units arranged in a side-by-side, two-tier configurration. The through-holes 15 are provided in each of the two tiers. However, the modular jack assembly is not limited to the above configuration and can take a variety of other configuratons.

The fourth embodiment is of the upper and lower indicator, right-angle optical pipe system. This system has upper and lower indicator members for the upper and lower tier units, respectively, and right-angle optical pipes for the upper tier units. Modular plugs plugged into the upper and lower openings 18*a* and 18*b*, respectively, face to each other.

In FIG. 16, LED's 6*a* and 6*b* are mounted on a horizontal board 9. The LED's 6*a* emit light in the vertical direction for the upper tier units while the LED's 6*b* emit light in the horizontal direction for the lower tier units. The LED's 6*b* are called "side view type" LED's.

Figure 20:
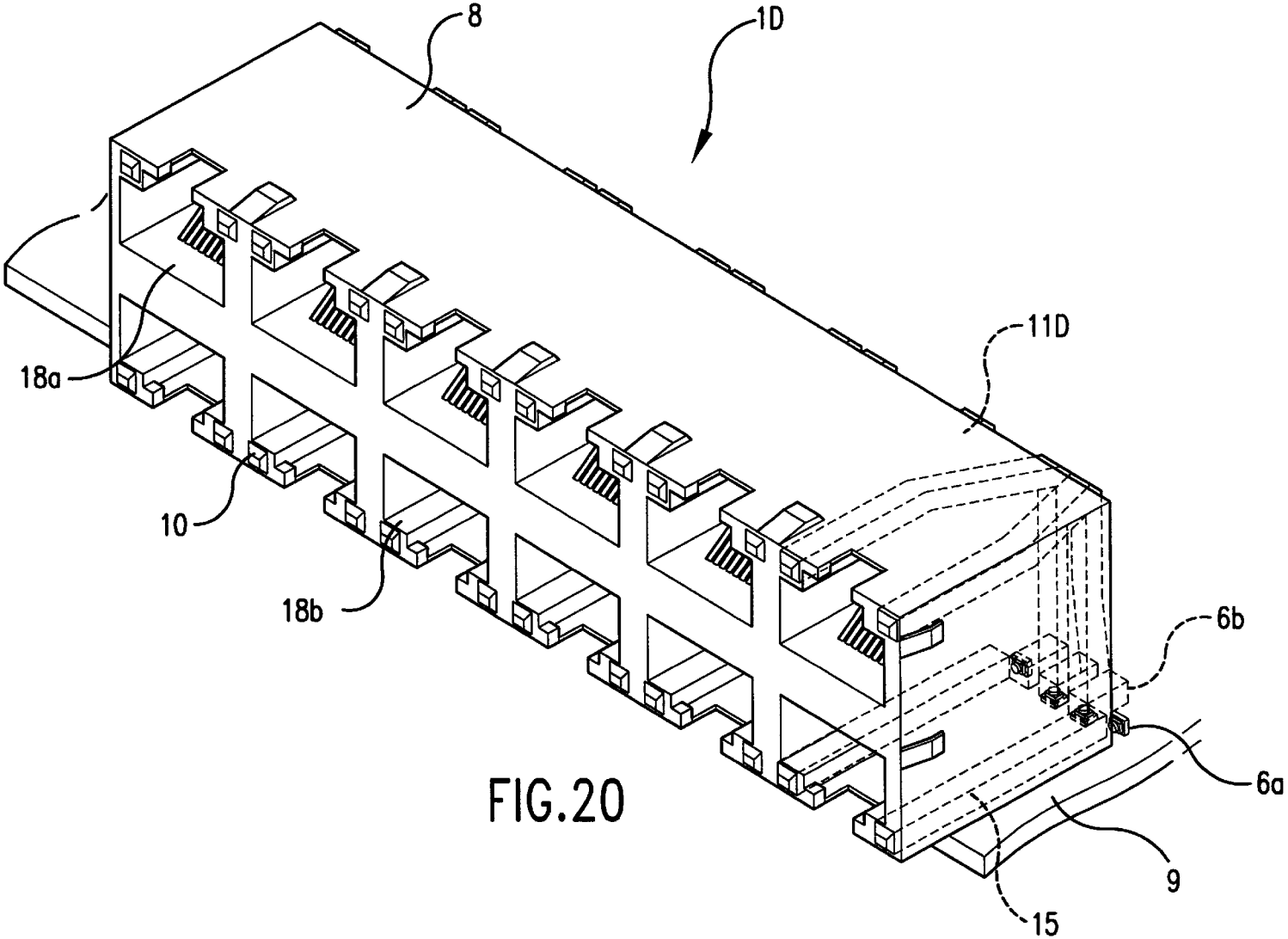
FIG. 20 is a perspective view of a modular jack assembly of the upper and lower indicator right angle optical pipe system.

The light of the LED's 6*a* and 6*b* is guided to the outside by the optical pipe 11D incorporated in the modular jack assembly 1D. An end face 13 of each optical pipe 11D is opposed to the LED 6*a* or 6*b*. The end face 13 is made flat. The other end face of the optical pipe 11D projects slightly from the front face of the modular jack assembly 1D to form an indicator member 10. A reflection face 14 is provided between the horizontal and vertical sections of the optical pipe 11 to direct the light of LED from the end face 13 to the other end face. The optical pipe 11 is bent at some positions corresponding to the display position. For example, in FIG. 16, the optical pipe 11D of the upper tier unit is diagonally bent along a rear wall of the housing 9. However, in FIG. 20, the optical pipe 11D is diagonally bent along an upper wall of the upper tier unit of the housing 9 instead of rear wall of the housing 9. These bendings of the optical pipe 11D have little influence on the optical performance.

Figure 18:
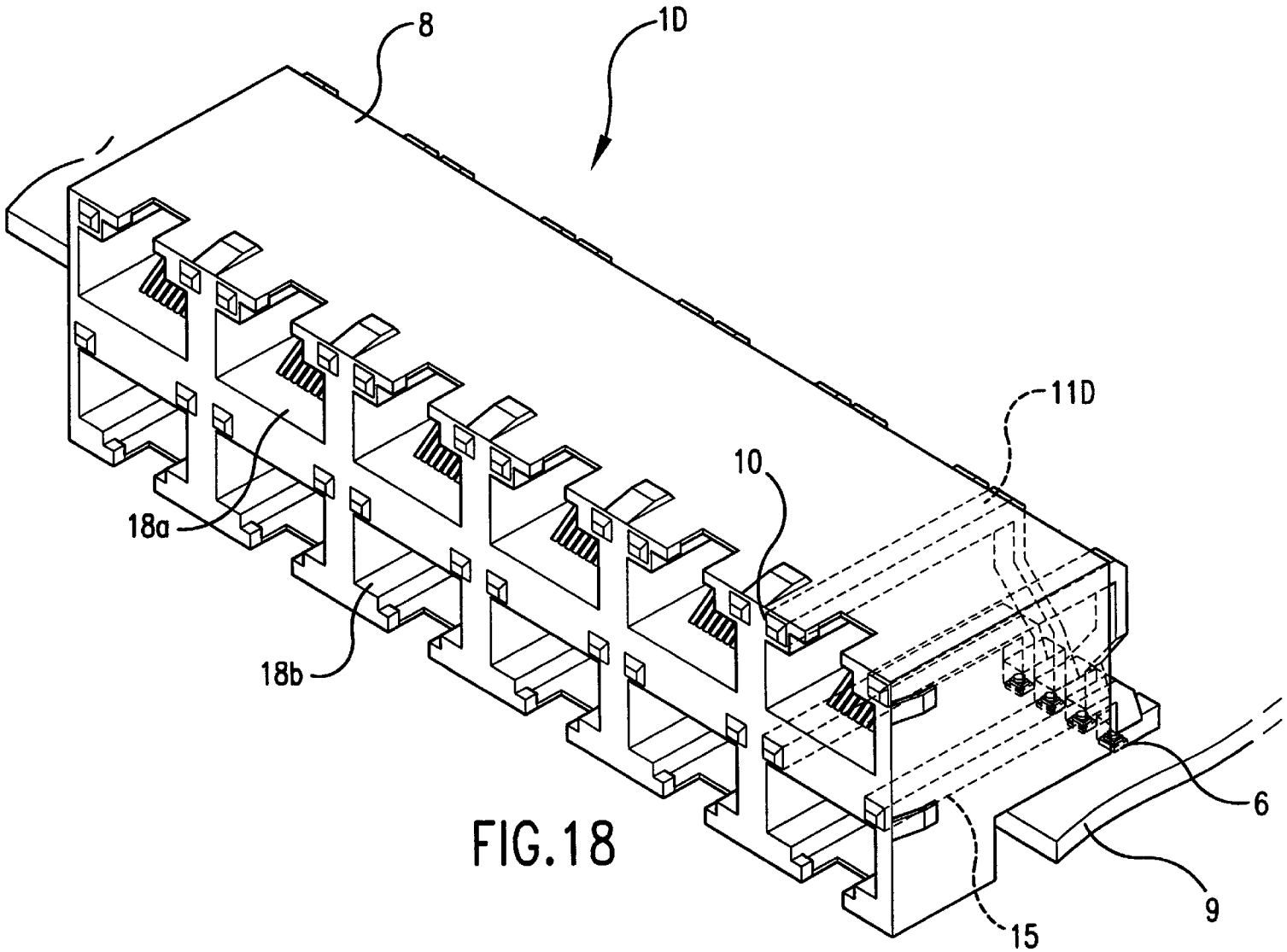
FIG. 18 is an upper indicator system modular jack assembly according to the fourth embodiment of the invention.
Figure 21:
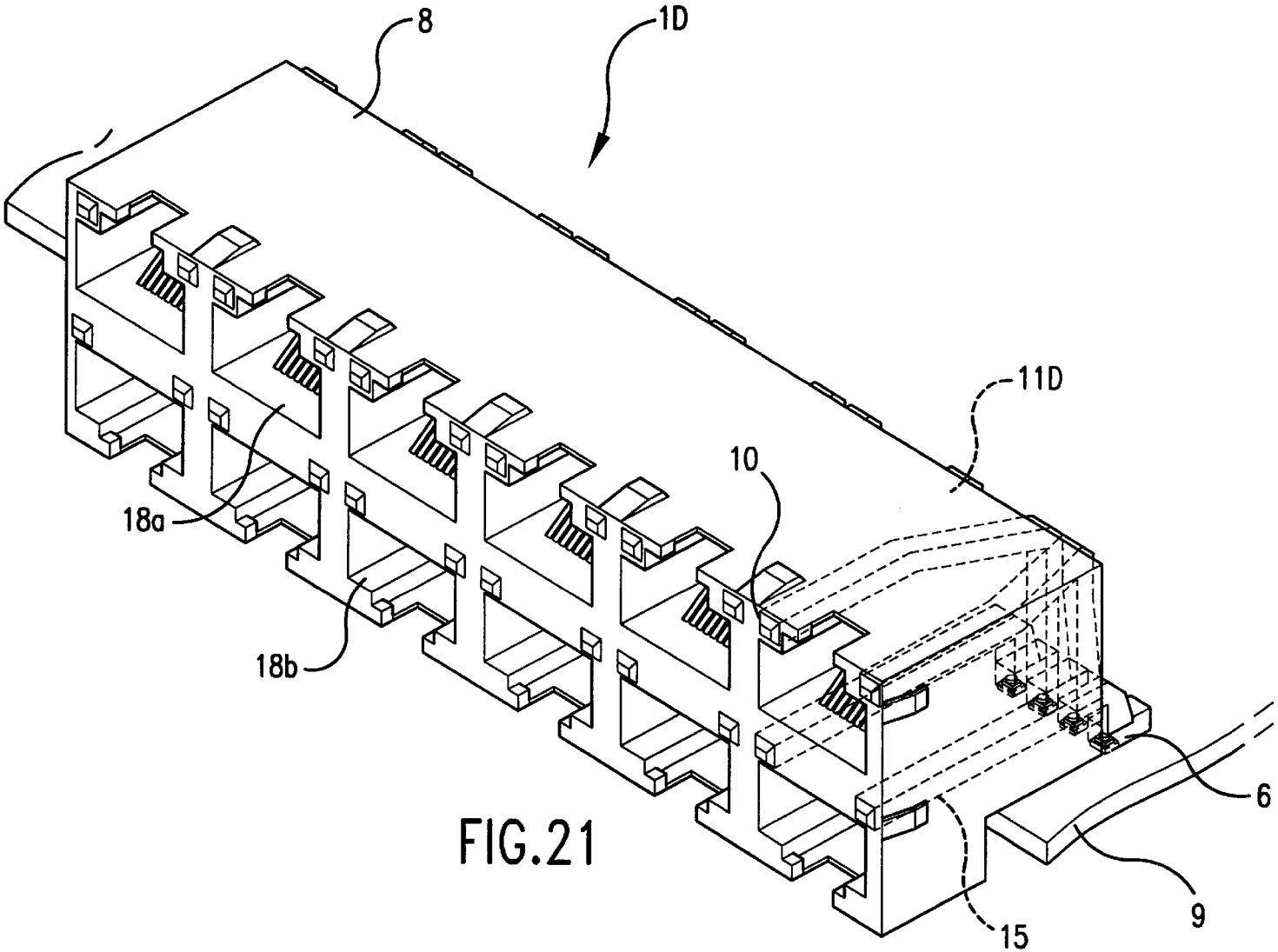
FIG. 21 is also a perspective view of a modular jack assembly of the upper and lower indicator right angle optical pipe system.

FIG. 18 shows a modification to the fourth embodiment. A plurality of indicator members 10 of both upper and lower tier modular jack sections are provided on the upper sides of each modular jack section. LED's 6 are provided behind the modular jack assembly 1D and mounted on the horizontal board 9 such that the LED's 6 emit light in the vertical direction. In this modification, too, it is easy to change the optical pipes 11D. Namely, in FIG. 21, the optical pipe 11D of the upper unit is diagonally bent along the upper wall of the upper tier unit instead of the rear wall of the housing 9.

Figure 19:
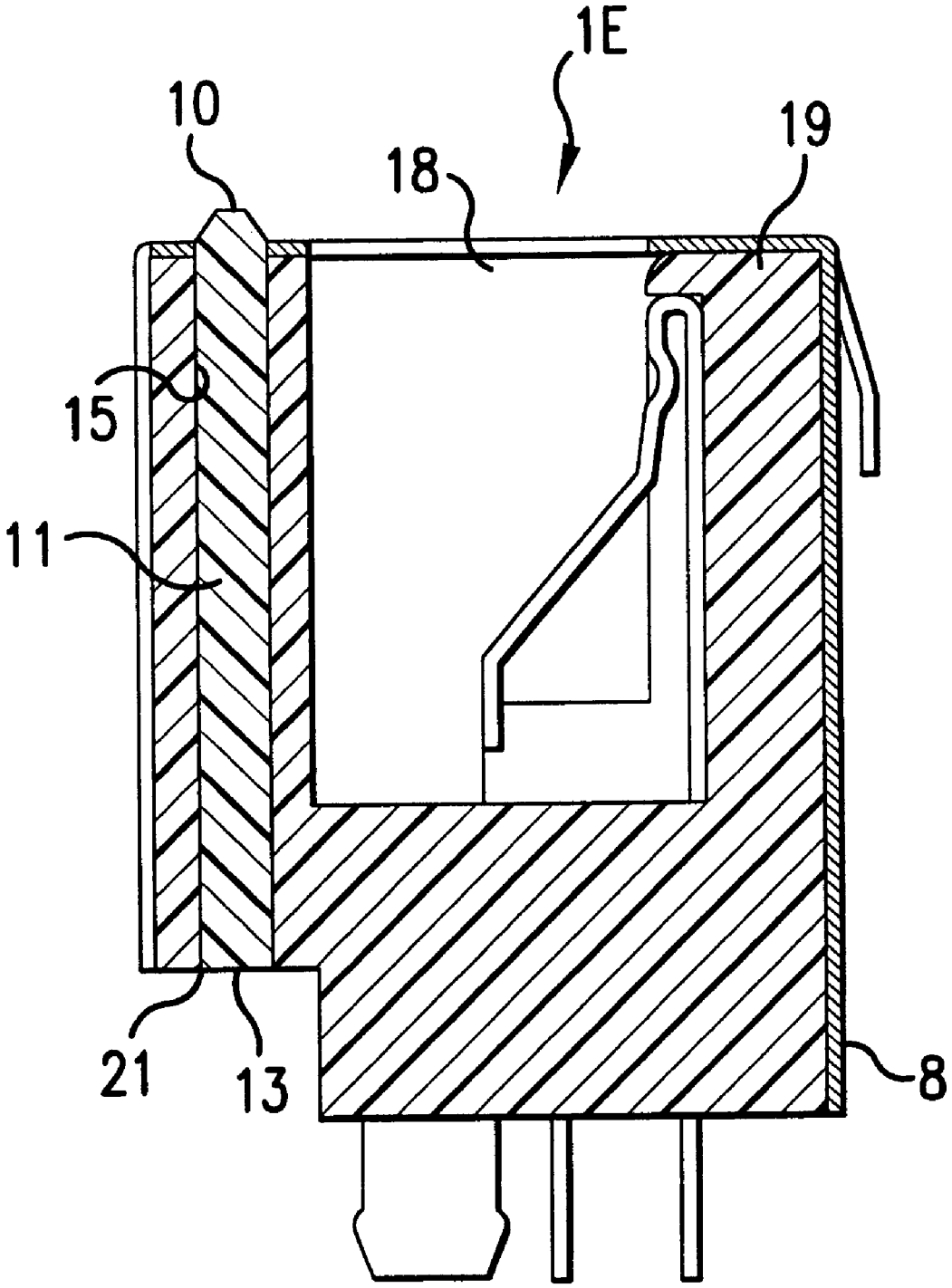
FIG. 19 is a straight type modular jack assembly according to the fifth embodiment of the invention.

In FIG. 19, a modular jack assembly 1E of the straight type have the same advantages as those of the embodiment of FIG. 2.

A variety of modifications can be applied to the invention. For example, the positions where optical pipes or fibers are provided are inverted, the optical pipes are replaced by optical fibers, or right-angle and straight optical pipes are mixed.

According to the invention there is provided a modular jack assembly with a compact indicator. A wide range of LED's can be used for the modular jack assembly. It is easy to move the indicator member to different positions and to replace LED's. In the multiple-link type connector, it is easy to incorporate optical pipes.

What is claimed is:

1. A modular jack assembly with an indicator, comprising:

a housing made of an insulative material and consisting of two tiers, each tier having at least one through-hole extending from a rear face of said housing to a front face of said housing and at least one opening for receiving a mating connector; and at least one light transmission means for transmitting light, provided in said through-hole and having a light receiving member at one end for receiving light from a corresponding light source mounted on a board outside said modular jack assembly and an indicator member at the other end for displaying said light to the outside of said modular jack assembly, said light receiving member disposed at one of positions along said rear face of said housing, said light source disposed at a position corresponding to said one of positions of said light receiving member, said transmission means provided in said through-hole of an upper tier extending upwardly from said light receiving member along said rear face and bent diagonally along said rear face and then at right angles into and through an upper wall of said upper tier, and said light transmission means provided in said through-hole of a lower tier extending upwardly from said light receiving member along said rear face and bent at right angles toward said front face of said housing.

2. A modular jack assembly with an indicator, comprising:

a housing made of an insulative material and consisting of two tiers, each tier having at least one through-hole extending from a rear face of said housing to a front face of said housing and at least one opening for receiving a mating connector; and at least one light transmission means for transmitting light, provided in said through-hole and having a light receiving member at one end for receiving light from a corresponding light source mounted on a board outside said modular jack assembly and an indicator member at the other end for displaying said light to the outside of said modular jack assembly, said light receiving member disposed at one of positions along said rear face of said housing, said light source disposed at a position corresponding to said one of positions of said light receiving member, said transmission means provided in said through-hole of an upper tier extending upwardly from said light receiving member along said rear face and bent diagonally along said rear face and then at right angles into and through an upper wall of said upper tier, and said light transmission means provided in said through-hole of a lower tier extending from said light receiving member straight toward said front face of said housing.

3. A modular jack assembly with an indicator, comprising:

a housing made of an insulative material and consisting of two tiers, each tier having at least one through-hole extending from a rear face of said housing to a front face of said housing and at least one opening for receiving a mating connector; and at least one light transmission means for transmitting light, provided in said through-hole and having a light receiving member at one end for receiving light from a corresponding light source mounted on a board outside of said modular jack assembly and an indicator member at the other end for displaying said light to the outside said modular jack assembly, said light receiving member disposed at one of positions along said rear face of said housing, said light source disposed at a position corresponding to said one of positions of said light receiving member, said transmission means provided in said through-hole of an upper tier extending upwardly from said light receiving member along said rear face, bent at right angles into an upper wall of said upper tier and then bent diagonally along said upper wall of said upper tier, and said light transmission means provided in said through-hole of a lower tier extending upwardly from said light receiving member along said rear face and bent at right angles toward said front face of said housing.

4. A modular jack assembly with an indicator, comprising:

a housing made of an insulative material and consisting of two tiers, each tier having at least one through-hole extending from a rear face of said housing to a front face of said housing and at least one opening for receiving a mating connector; and at least one light transmission means for transmitting light, provided in said through-hole and having a light receiving member at one end for receiving light from a corresponding light source mounted on a board outside of said modular jack assembly and an indicator member at the other end for displaying said light to the outside said modular jack assembly, said light receiving member disposed at one of positions along said rear face of said housing, said light source disposed at a position corresponding to said one of positions of said light receiving member, said transmission means provided in said through-hole of an upper tier extending upwardly from said light receiving member along said rear face, bent at right angles into an upper wall of said upper tier and then bent diagonally along said upper wall of said upper tier, and said light transmission means provided in said through-hole of a lower tier extending from said light receiving member straight toward said front face of said housing.

* * * * *